US012171326B2

(12) United States Patent
Lee et al.

(10) Patent No.: US 12,171,326 B2
(45) Date of Patent: Dec. 24, 2024

(54) CLOTHES DRYER

(71) Applicant: Samsung Electronics Co., Ltd., Suwon-si (KR)

(72) Inventors: Bo Kyung Lee, Suwon-si (KR); Jung Ha Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 518 days.

(21) Appl. No.: 17/448,845

(22) Filed: Sep. 24, 2021

(65) Prior Publication Data

US 2022/0007826 A1 Jan. 13, 2022

Related U.S. Application Data

(63) Continuation of application No. PCT/KR2020/002473, filed on Feb. 20, 2020.

(30) Foreign Application Priority Data

Mar. 27, 2019 (KR) ..... 10-2019-0034779

(51) Int. Cl.
*A46B 5/00* (2006.01)
*D06F 58/26* (2006.01)

(52) U.S. Cl.
CPC ..... *A46B 5/0058* (2013.01); *A46B 5/0083* (2013.01); *D06F 58/26* (2013.01); *A46B 2200/3073* (2013.01)

(58) Field of Classification Search
CPC ..... D06F 58/26; D06F 58/206; D06F 58/22; D06F 58/24; D06F 58/45; A46B 5/0058; A46B 5/0083; A46B 2200/3073; B01D 46/42; B08B 1/00; B08B 1/12; F28G 1/02
See application file for complete search history.

(56) References Cited

U.S. PATENT DOCUMENTS

| | | | | |
|---|---|---|---|---|
| 8,490,294 | B2 | 7/2013 | Grunert | |
| 9,609,939 | B2 * | 4/2017 | Alvarez | B25G 3/30 |
| 9,657,431 | B2 | 5/2017 | Kim et al. | |
| 2009/0031513 | A1 | 2/2009 | Goldberg et al. | |

FOREIGN PATENT DOCUMENTS

| | | | |
|---|---|---|---|
| EP | 1987190 | B1 | 3/2013 |
| JP | H04-17793 | U | 2/1992 |
| JP | H05-49795 | A | 3/1993 |
| JP | 2007-037690 | A | 2/2007 |

(Continued)

OTHER PUBLICATIONS

Translation, KR-101511988-B1 (Year: 2015).*

(Continued)

*Primary Examiner* — Jessica Yuen

(57) ABSTRACT

The present disclosure relates to a clothes dryer having a structure capable of cleaning a heat exchanger. The clothes dryer includes a main body, a drum rotatably provided in the main body, a heat exchanger provided to supply hot and dry air to an inside of the drum, and a cleaning device detachably installed in the main body to clean the heat exchanger, wherein the cleaning device includes a brush provided to come into contact with at least one surface of the heat exchanger, and a brush handle provided to move the brush.

15 Claims, 13 Drawing Sheets

(56) References Cited

FOREIGN PATENT DOCUMENTS

| | | | | |
|---|---|---|---|---|
| JP | 2010-005097 | A | | 1/2010 |
| JP | 2018-069181 | A | | 5/2018 |
| KR | 10-0199682 | B1 | | 6/1999 |
| KR | 10-2004-0056811 | A | | 7/2004 |
| KR | 10-2012-0029251 | A | | 3/2012 |
| KR | 10-1199394 | B1 | | 11/2012 |
| KR | 10-2014-0050984 | A | | 4/2014 |
| KR | 101511988 | B1 | * | 4/2015 |
| KR | 10-2020-0113905 | A | | 10/2020 |
| TW | M544242 | U | * | 7/2017 |

OTHER PUBLICATIONS

Translation, TW-M544242-U (Year: 2017).*
International Search Report and Written Opinion of the International Searching Authority dated Jun. 18, 2020 in connection with International Application No. PCT/KR2020/002473, 6 pages.
Notice of Preliminary Rejection dated Mar. 9, 2024, in connection with Korean Application No. 10-2019-0034779, 7 pages.
Notice of Patent Allowance dated Sep. 19, 2024, in connection with Korean Application No. 10-2019-0034779, 3 pages.

* cited by examiner

CLOTHES DRYER

CROSS-REFERENCE TO RELATED APPLICATIONS

This application is a continuation of International Application No. PCT/KR2020/002473, filed Feb. 20, 2020, which claims priority to Korean Patent Application No. 10-2019-0034779, filed Mar. 27, 2019, the disclosures of which are herein incorporated by reference in their entirety.

BACKGROUND

1. Field

The present disclosure relates to a clothes dryer, and more particularly, to a clothes dryer having an improved cleaning structure of a heat exchanger

2. Description of the Related Art

In general, a clothes dryer is a device that dries wet laundry accommodated in a drying tub by forcibly blowing hot air into the drying tub. Clothes dryers are basically similar to drum washing machines in appearance, and dry laundry by forcibly circulating hot air heated through a heater and a blowing fan into the drying tub.

Clothes dryers may be classified into condensation type dryers and exhaust type dryers.

In the condensation type dryer, air in a humid state by heat exchange with laundry in the drying tub is circulated without being discharged to the outside of the dryer, and the circulated air is heat-exchanged with external air in a separate condenser to generate condensate, and the generated condensate is discharged to the outside In the exhaust type dryer, air in a humid state by heat exchange with laundry in the drying tub is discharged directly to the outside of the dryer.

Among them, the condensation type dryer has the advantage of low energy consumption and high thermal efficiency by using a heat pump, and has been widely used in recent years.

However, the heat pump is composed of an evaporator, a compressor, and a condenser through which a refrigerant circulates, and lint and foreign substances generated in the drying tub may be accumulated on an inlet side of an air passage connected to the evaporator.

When wet laundry is put into the drying tub and drying is performed, lint, fluff, and foreign substances such as dust and hairs attached to the laundry are generated. The lint and foreign substances move along the air passage together with the air, and thus a filter may be installed in an air passage at an inlet side of a heat exchanger to collect the lint and foreign substances.

However, fine-sized lint or foreign substances that are not filtered out by the filter may adhere to the heat exchanger inside the condensation type dryer to obstruct the flow of air, so that heat exchange efficiency may be reduced to lower the performance of the dryer.

SUMMARY

The present disclosure is directed to providing a clothes dryer having a structure capable of cleaning a heat exchanger.

The present disclosure is directed to providing a clothes dryer capable of keeping a heat exchanger inside the clothes dryer clean.

The present disclosure is directed to providing a clothes dryer capable of allowing a user to conveniently and easily perform cleaning of a heat exchanger.

The present disclosure is directed to providing a clothes dryer having a structure capable of collecting and discharging dust within a heat exchanger.

An aspect of the present disclosure provides a clothes dryer including a main body, a drum rotatably provided in the main body, a heat exchanger provided to supply hot and dry air to the inside of the drum, and a cleaning device detachably installed in the main body to clean the heat exchanger, wherein the cleaning device includes a first frame, a second frame detachably coupled to the first frame, a brush provided on the first frame to come into contact with least one surface of the heat exchanger, a brush handle provided on the second frame to move the brush, and a handle guide provided on the second frame to guide the movement of the brush handle.

The brush may include a first brush connected to the brush handle, and a second brush provided to interlock with the first brush.

The clothes dryer may further include a rotatable joint provided to rotatably connect the first brush and the second brush.

The first brush may include first bristles provided to come into contact with a surface of the heat exchanger, and a first brush hinge on which the first bristles are mounted and rotatably provided about a first rotation shaft so that the first bristles are movable.

The second brush may include a second bristles provided to come into contact with the surface of the heat exchanger, and a second brush hinge on which the second bristles are mounted and rotatably provided about a second rotation shaft so that the second bristles are movable.

The first brush and the second brush may be provided to rotate in opposite directions.

At least one of the first brush hinge and the second brush hinge may further include a cutout portion formed by cutting at least a portion.

At least one of the first brush hinge and the second brush hinge may further include an air flow passage formed by opening at least a portion or the whole for air flow.

The rotatable joint may include a first connection gear provided on the first brush, and a second connection gear provided on the second brush, and the first connection gear and the second connection gear may be connected to rotate in opposite directions.

The first connection gear may be disposed on the first rotation shaft, and the second connection gear may be disposed on the second rotation shaft, wherein when the first rotation shaft rotates in a first direction CCW by the rotation of the first brush hinge, the second rotation shaft may rotate in a second direction CW that is opposite to the first direction, so that the first bristles and the second bristles may intermingle.

At least one surface of the first frame may further include a dust receiving plate extending to a length of the first bristles and the second bristles.

The dust receiving plate may be formed to be inclined with respect to the at least one surface of the first frame.

The clothes dryer may further include a rotation bracket provided to rotatably support the first rotation shaft and the second rotation shaft, wherein the rotation bracket may be provided on the first frame.

The first frame may further include a space portion formed to allow air to flow.

The first bristles and the second bristles may be provided to have different materials.

Another aspect of the present disclosure provides a clothes dryer including a drum rotatably provided in a main body, a heat pump including an evaporator, a compressor, a condenser, and an expansion valve to supply air to the inside of the drum, a brush provided to come into contact with a surface of the evaporator to remove foreign substances, and a brush handle provided to move the brush, wherein the brush includes a first brush connected to the brush handle, and a second brush disposed to face the first brush and provided to interlock with the rotation of the first brush.

The first brush may include a first bristles provided to come into contact with the surface of the evaporator, and a first brush hinge on which the first bristles are mounted and rotatably provided about a first rotation shaft so that the first bristles are movable.

The second brush may include a second bristles provided to come into contact with the surface of the evaporator, and a second brush hinge on which the second bristles are mounted and rotatably provided about a second rotation shaft so that the second bristles are movable.

When the first rotation shaft rotates in a first direction CCW by the rotation of the brush handle, the second rotation shaft may rotate in a second direction CW that is opposite to the first direction, so that the first bristles and the second bristle may intermingle.

At least one of the first brush and the second brush may further include an air flow passage formed by opening at least a portion for air flow.

According to one aspect of the present disclosure, a heat exchanger can be kept clean by a brush device provided to collect and discharge dust by direct contact with the heat exchanger inside a clothes dryer.

Further, according to one aspect of the present disclosure, the heat exchanger can allow a user to conveniently and easily clean.

DETAILED DESCRIPTION

Hereinafter, embodiments of the present disclosure will be described in detail with reference to the accompanying drawings. In this specification, the terms "front end," "rear end," "upper portion," "lower portion," "upper end" and "lower end" used in the following description are defined with reference to the drawings, and the shape and position of each component are not limited by these terms.

Figure 1:
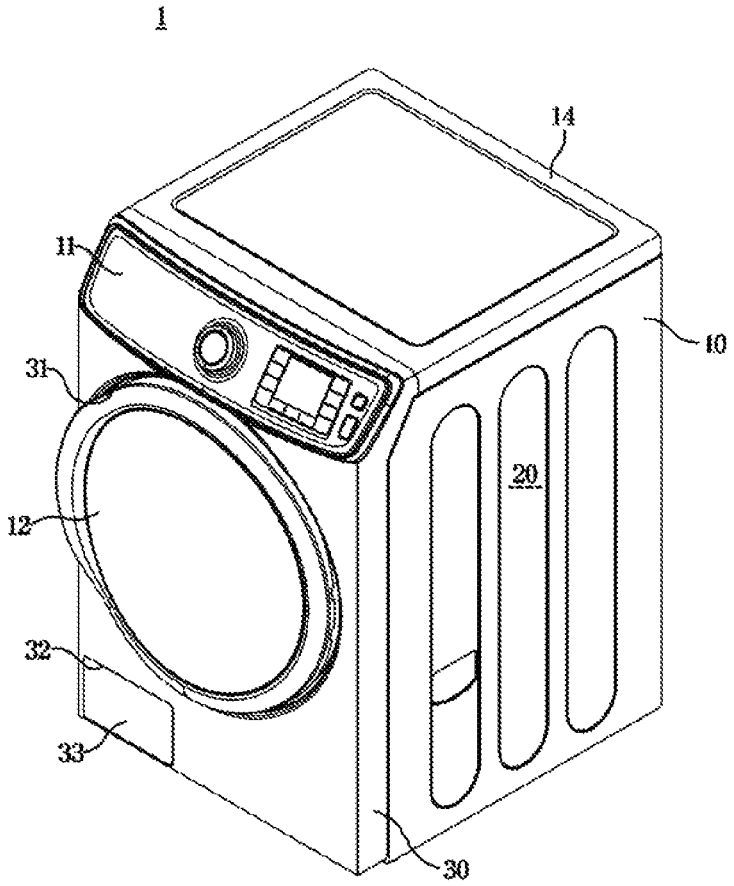
FIG. 1 is a perspective view illustrating an exterior of a clothes dryer according to an embodiment of the present disclosure.
Figure 2:
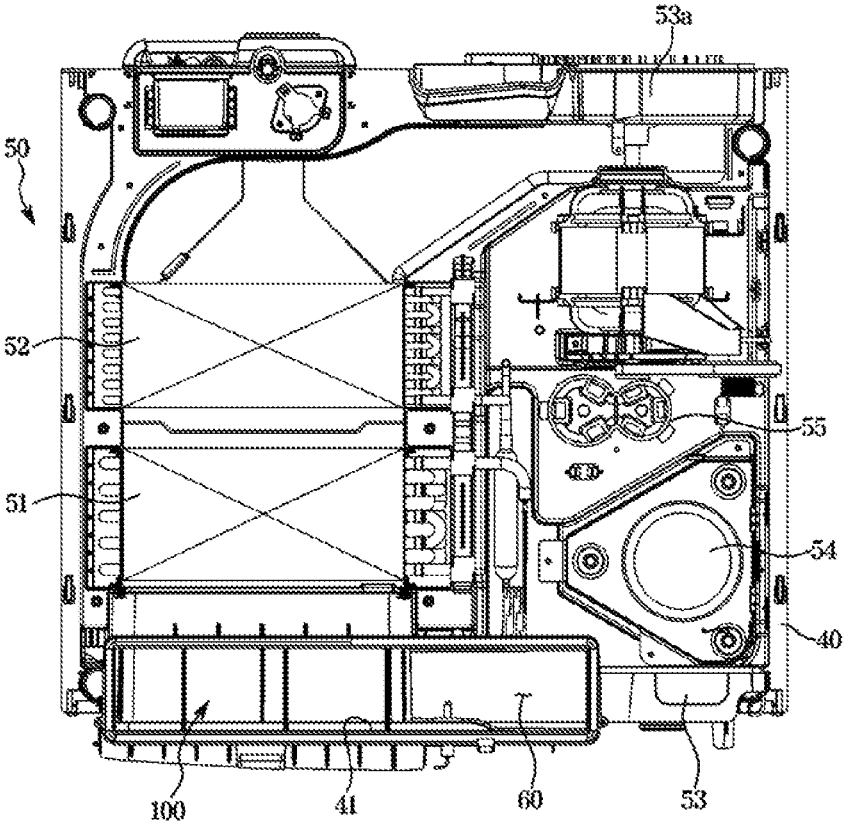
FIG. 2 is a view illustrating a heat pump of the clothes dryer according to an embodiment of the present disclosure.
Figure 3:
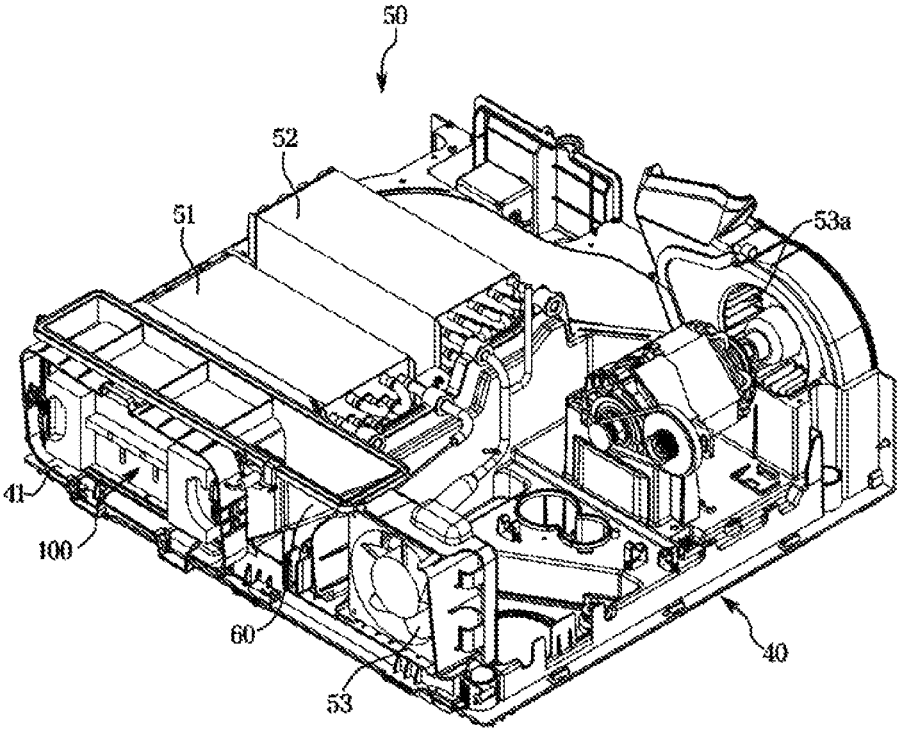
FIG. 3 is a view illustrating the heat pump on which a cleaning device is installed according to an embodiment of the present disclosure.

FIG. 1 is a perspective view illustrating an exterior of a clothes dryer according to an embodiment of the present disclosure, FIG. 2 is a view illustrating a heat pump of the clothes dryer according to an embodiment of the present disclosure, and FIG. 3 is a view illustrating the heat pump on which a cleaning device is installed according to an embodiment of the present disclosure.

As illustrated in FIGS. 1 to 3, a clothes dryer 1 includes a main body 10 forming an external appearance, and a drum 20 rotatably installed in the main body 10.

The main body 10 is provided in a substantially hexahedral shape. An opening 31 is formed on a front surface of the main body 10 to put or take out clothes (not shown), which are objects to be dried, into or out of the drum 20. The opening 31 may be opened and closed by a door 12. A control panel 11 to control an operation of the clothes dryer 1 may be provided on an upper side of the front surface of the main body 10.

A drum 12 having a cylindrical shape is provided inside the main body 10. The drum 12 is installed to be rotate by receiving power from a driving device (not shown). Although not shown, the driving device may include a configuration capable of receiving a rotational force including a motor and a belt. The drum 20 accommodates objects to be dried therein so that drying may be performed.

The main body 10 may include a front cover 30 forming the front surface, a top cover 14 forming an upper surface, and a base 40 forming a bottom surface. An embodiment of the present disclosure illustrates that the front cover, the top cover, and the base forming the main body are separately provided and assembled, but the present disclosure is not limited thereto. For example, at least one part of the main body including the front cover, the top cover, and the base may be integrally formed.

The door 12 is installed on the opening 31 formed on the front cover 30 to open or close the front opening 31 so that the objects to be dried may be put into or taken out of the drum 12 through the front opening 31.

The front cover 30 of the main body 10 may be provided with a cleaning device installation hole 32 to allow a cleaning device 100, which will be described later, to be attached and detached in the front. The cleaning device installation hole 32 may be formed to be opened at a lower side of the front cover 30. An installation hole cover 33 to open or close the cleaning device installation hole 32 may be provided on the cleaning device installation hole 32. The installation hole cover 33 may be detachably installed on the cleaning device installation hole 32.

A duct 60 to form a flow path of air to be introduced into the drum may be installed in the main body 10. The duct 60 may be provided on a lower front side of the drum 20 to pass air discharged from the drum 20 after being used for drying.

The duct 60 may be installed on the base 40 provided below the drum 20. A filter (not shown) to filter out foreign substances such as lint contained in air discharged from the drum 20 may be further installed in the duct 60.

A blowing fan 53 is installed in the duct 60 to deliver hot and humid air discharged from the drum 20 to the evaporator 51 side. The blowing fan 53 may be provided to circulate the hot and humid air discharged from the drum 20 along the duct 60. The duct 60 is provided such that the hot and humid air discharged from the drum 20 may move toward the evaporator 51.

The evaporator 51 may constitute a heat pump 50 together with a condenser 52, a compressor 54, and an expansion valve 55. The heat pump 50 is provided to remove moisture by cooling hot air while a refrigerant circulates and to heat the dehumidified air again. The evaporator 51 and the condenser 52 of the heat pump 50 may be disposed on one side of the base 40 so that lower portions thereof are supported.

The evaporator 51 removes moisture by cooling hot and humid air. Condensed water generated while the evaporator 51 dehumidifies the hot and humid air may be collected below the evaporator 51 and discharged to the outside.

The evaporator 51 includes a plurality of heat dissipation fins (not shown) overlapping and spaced apart from each other and a refrigerant pipe (not shown) penetrating the heat dissipation fins. The plurality of heat dissipation fins is arranged parallel to each other to form channels through which air passes.

The refrigerant in the heat pump 50 is compressed in the compressor 54 after receiving heat from hot air at the evaporator 51 and then supplied to the condenser 52. The air dehumidified at the evaporator 51 may be delivered to the condenser 52 to be heated by the refrigerant and then may be introduced into the drum 20 again.

The air dehumidified by the evaporator 51 may be discharged to the outside of the main body 10 by a fan device 53*a*.

The evaporator 51 and the condenser 52 of the heat pump 50 are provided to directly exchange heat with air introduced into the main body 10 and the base 40. Because the hot and humid air is exchanged with the refrigerant through the evaporator 51 and the condenser 52 to change to hot and dry air, the evaporator 51 and the condenser 52 may be referred to as heat exchangers.

Foreign substances such as dust and lint contained in the hot air discharged from the drum 20 may adhere to the evaporator 51 (hereinafter, heat exchanger). The foreign substances such as dust and lint attached to the evaporator 51 may cause clogging of an air passage.

A cleaning device 100 provided to clean foreign substances such as dust and lint that cause clogging of the air passage may be provided in front of the heat exchanger 51.

The cleaning device 100 may be installed on a cleaning device installation part 41 provided on the base 40. The cleaning device installation part 41 may be provided at a position of the base 40 corresponding to the heat exchanger 51.

The cleaning device 100 may be installed on the front cover 30 of the main body 10 to be detachable from the front.

Figure 4:
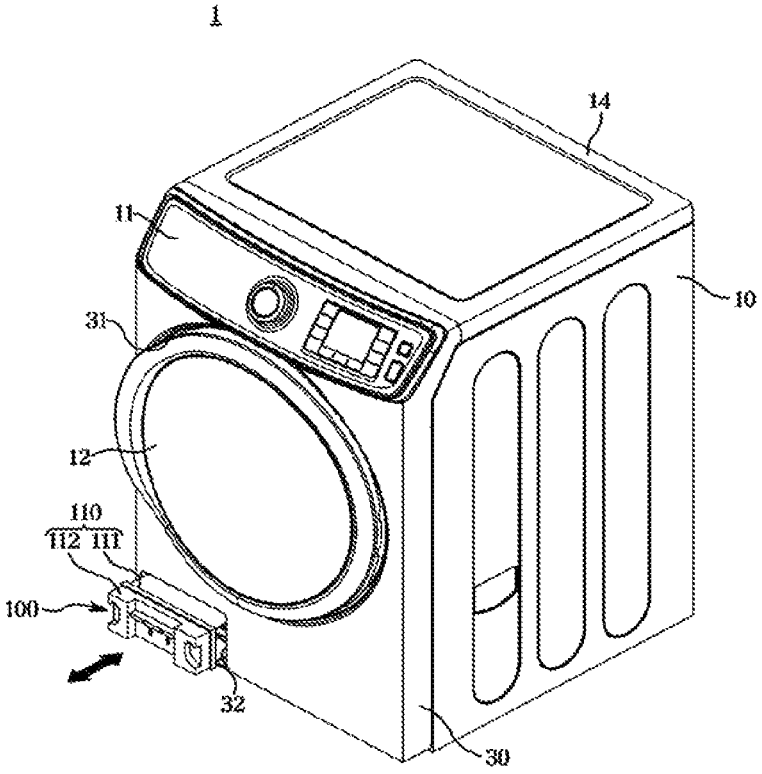
FIG. 4 is a view illustrating that the cleaning device is separated according to an embodiment of the present disclosure.
Figure 5:
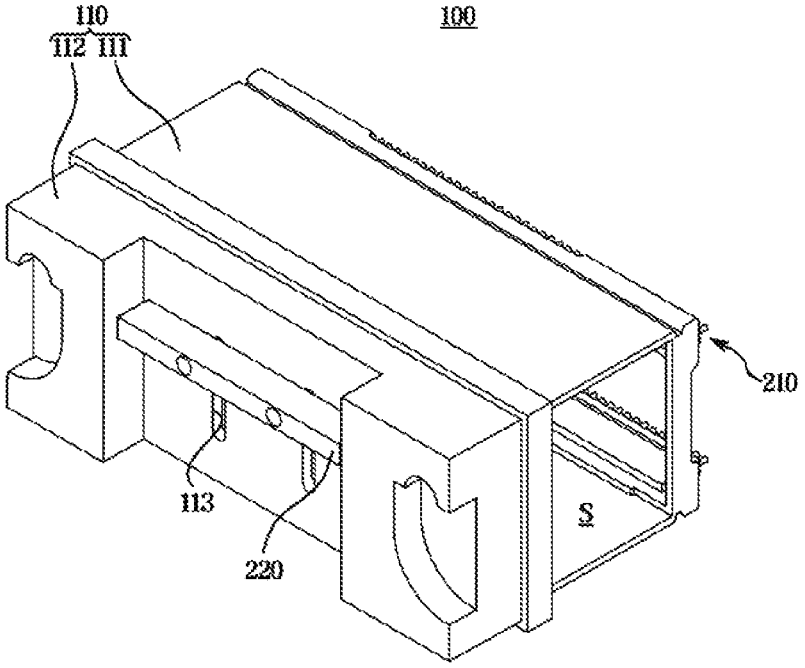
FIG. 5 is a perspective view of the cleaning device according to an embodiment of the present disclosure.
Figure 6:
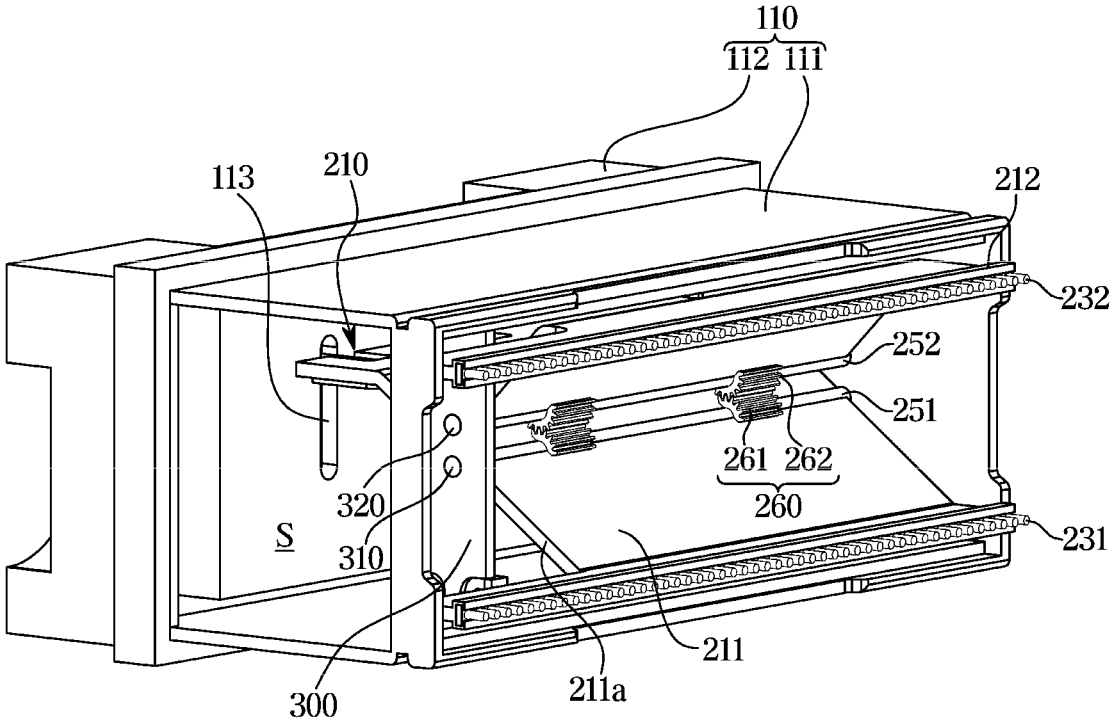
FIG. 6 is a rear perspective view of the cleaning device according to an embodiment of the present disclosure.
Figure 7:
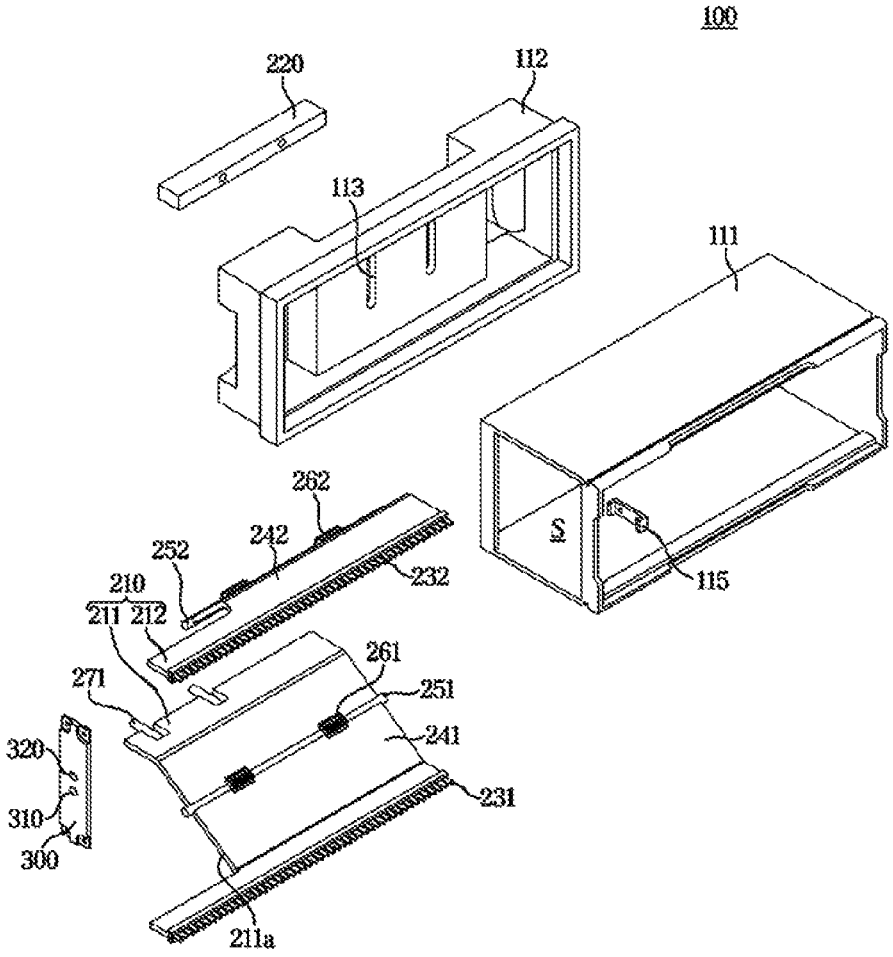
FIG. 7 is an exploded perspective view of the cleaning device according to an embodiment of the present disclosure.

FIG. 4 is a view illustrating that the cleaning device is separated according to an embodiment of the present disclosure, FIG. 5 is a perspective view of the cleaning device according to an embodiment of the present disclosure, FIG. 6 is a rear perspective view of the cleaning device according to an embodiment of the present disclosure, and FIG. 7 is an exploded perspective view of the cleaning device according to an embodiment of the present disclosure.

As illustrated in FIGS. 4 to 7, the cleaning device 100 may be provided to be detachable from the main body 10. The cleaning device 100 may be mounted on the front cover 30 of the main body 10 to be detachable from the front. The cleaning device 100 is provided to be inserted into the cleaning device installation hole 32 formed on the front cover 30. The cleaning device 100 may be formed in a size and shape corresponding to the cleaning device installation hole 32 formed on the front cover 30.

A user may visually check a surface of the heat exchanger 51 through the cleaning device installation hole 32 formed on the front cover 30. The user may separate the cleaning device 100 from the main body 10 by opening the installation hole cover 33 of the front cover 30. The user may selectively collect and discharge dust by visually checking the surface of the heat exchanger 51.

The cleaning device 100 is formed of one frame 110. The frame 110 includes a first frame 111 and a second frame 112 provided to be detachable from the first frame 111. The first frame 111 and the second frame 112 may be combined to form one body. The second frame 112 may be disposed in front of the first frame 111.

The frame 110 may be formed in a size and shape corresponding to the cleaning device installation hole 32 of the front cover 30. The first frame 111 may be disposed in the rear of the main body 10, and the second frame 112 may be disposed in front of the first frame 111 to be disposed in the front of the main body 10. Therefore, when the cleaning device 100 is taken out from the cleaning device installation hole 32, the second frame 112 is first separated from the main body 10 and then the first frame 111 connected to the second frame 112 is may be separated.

The first frame 111 may be further provided with a space portion S formed to allow air in the main body 10 to flow. The space portion S may be formed on one side of the first frame 111. At least a part of the cleaning device 100, which will be described later, is not installed in the space portion S of the first frame 111, so that the flow of air flowing inside the main body 10 may not be disturbed.

The cleaning device 100 may include a brush 210 provided to come into contact with the heat exchanger 51 and a brush handle 220 provided to enable the brush 210 to move.

The brush 210 is disposed to come into contact with one surface of the heat exchanger 51. The brush 210 may be provided on the first frame 111. The brush handle 220 may be provided on the second frame 112. A handle guide 113 may be formed on the second frame 112 to guide the movement of the brush handle 220. The handle guide 113 may be formed on the second frame 112 in a vertical direction. The handle guide 113 may be formed of at least one groove. The handle guide 113 may be formed to move the brush handle 220 in the vertical direction.

The second frame 112 may be exposed from the cleaning device installation hole 32 of the front cover 30 so that the user may drive the brush handle 220. The brush handle 220 of the second frame 112 provided in the cleaning device installation hole 32 may be gripped by the user to be operated when the installation hole cover 33 of the front cover 30 is opened.

The brush 210 may include a first brush 211 connected to the brush handle 220 and a second brush 212 provided to interlock with the first brush 211.

The first brush 211 may include first bristles 231 provided to come into contact with a surface 51*a* of the heat exchanger 51, and a first brush hinge 241 on which the first bristles 231 are mounted. The first bristles 231 may be installed at one end of the first brush hinge 241. The first bristles 231 may be detachably installed on the first brush hinge 241. The first bristles 231 may be detachably installed on the first brush hinge 241 to enable replacement and cleaning of the first bristles 231.

The first bristles 231 may be provided to come into contact with the surface 51*a* of the heat exchanger 51 to remove foreign substances such as lint and dust. The first bristles 231 may include various materials. The first bristles 231 may include a plurality of bristles. An embodiment of the present disclosure illustrates that the first bristles 231 is provided such that a plurality of bristles is arranged side by side in a line, but the present disclosure is not limited thereto. For example, the first bristles 231 may be provided such that bristles of a hard material and bristles of a soft material are arranged in various shapes.

The first brush hinge 241 is provided to be rotatable by a predetermined angle so that the first bristles 231 installed at one end thereof is vertically movable. The first brush hinge 241 may be formed in a plate shape. The first brush hinge 241 may be provided with a first rotation shaft 251 provided such that the first brush 211 is rotatable. The first bristles 231 may be provided to be rotatable about the first rotation shaft 251. The first brush hinge 241 may include a first brush handle insert 271 so that the brush handle 220 may be connected. The first brush handle insert 271 may be disposed on the other side of the first brush hinge 241 opposite to one side on which the first bristles 231 is provided. That is, the first brush hinge 241 rotates about the first rotation shaft 251 located at the center thereof. When the first brush handle insert 271 is pressed, the first brush hinge 241 rotates about the first rotation shaft 251 so that the first bristles 231 may move in the vertical direction.

The second brush 212 is provided to come into contact with the surface 51*a* of the heat exchanger 51 to remove foreign substances such as lint and dust. The second brush 212 may include a second bristles 232 provided to come into contact with the surface 51*a* of the heat exchanger 51, and a second brush hinge 242 on which the second bristles 232 is mounted. The second bristles 232 may be installed at one end of the second brush hinge 242. The second bristles 232 may be detachably installed on the second brush hinge 242. The second bristles 232 is provided to be detachably installed on the second brush hinge 242 to enable replacement and washing.

The second bristles 232 may include various materials. The second bristles 232 may include a plurality of bristles. An embodiment of the present disclosure illustrates that the second bristles 232 is provided such that a plurality of bristles is arranged side by side in a line, but the present disclosure is not limited thereto. For example, the second bristles 232 may be provided such that bristles of a hard material and bristles of a soft material are arranged in various shapes.

The first bristles 231 and the second bristles 232 may be formed of different materials. The first bristles 231 and the second bristles 232 may be formed to have different hardness and thickness.

The second brush hinge 242 is provided to be rotatable by a predetermined angle so that the second bristles 232 installed at one end thereof is vertically movable. The second brush hinge 242 may be formed in a plate shape. The second brush hinge 242 may be provided with a second rotation shaft 252 provided such that the second brush 212 is rotatable. The second bristles 232 may be provided to be movable about the second rotation shaft 252.

An embodiment of the present disclosure illustrates that the positions of the first and second rotation axes are disposed at the centers of the first and second brush hinges, respectively, but the present disclosure is not limited thereto. For example, the positions of the first and second rotation shafts may be disposed to be eccentric from the centers of the first and second brush hinges and the first frame.

The first brush 211 and the second brush 212 may be rotatably connected to each other by a rotatable joint 260. The rotatable joint 260 may include a first connection gear 261 provided on the first brush 211 and a second connection gear 262 provided on the second brush 212.

The first connection gear 261 and the second connection gear 262 may be connected to rotate in opposite directions. The first connection gear 261 is provided on the first rotation shaft 251 of the first brush 211. The second connection gear 262 is provided on the second rotation shaft 252 of the second brush 212.

The first brush 211 and the second brush 212 of the cleaning device 100 are disposed inside the first frame 111. A rotation bracket 300 to support the first brush hinge 241 and the second brush hinge 242 of the cleaning device 100 to be rotatably mounted may be provided on the first frame 111. A first rotation shaft installation hole 310 to rotatably connect the first rotation shaft 251 of the first brush hinge 241 is formed on the rotation bracket 300. A second rotation shaft installation hole 320 to rotatably connect the second rotation shaft 252 of the second brush hinge 242 is formed on the rotation bracket 300. The first rotation shaft 251 and the second rotation shaft 252 may be disposed on a coaxial line with each other in the vertical direction. The first rotation shaft installation hole 310 and the second rotation shaft installation hole 320 may be disposed to be spaced apart from each other by a predetermined distance. The first rotation shaft installation hole 310 and the second rotation shaft installation hole 320 may be disposed on a coaxial line with each other in the vertical direction of the rotation bracket 300.

The rotation bracket 300 may be formed outside the space portion S of the first frame 111. The rotation bracket 300 may be provided so as not to overlap the space portion S formed in the first frame 111. The frame 110 may be provided with the first frame 111 to which the rotation bracket 300 is fixed.

The first brush hinge 241 may have a cutout portion 211*a* formed by cutting at least a portion of the first brush hinge 241 to avoid the space portion S. The cutout portion 211*a* may be formed by cutting at least one side of the first brush hinge 241. Air in the main body 10 may flow toward the heat exchanger 51 without interference by the cutout portion 211*a* of the first brush hinge 241 as described above.

Figure 8:
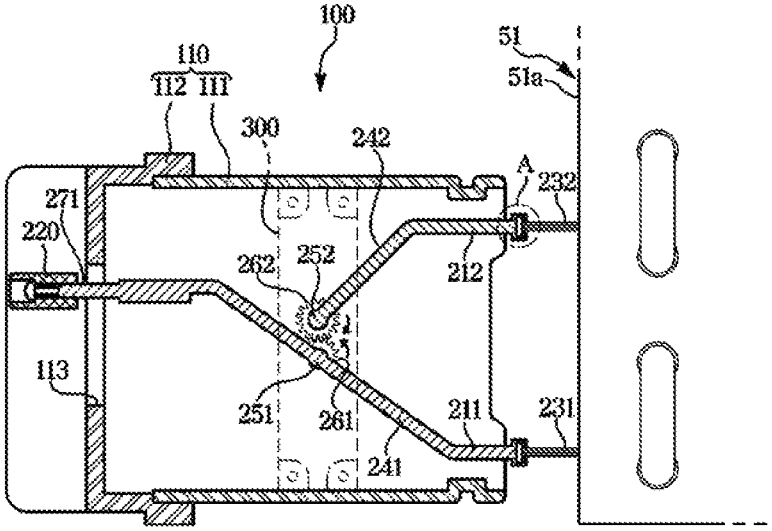
FIGS. 8 and 9 are views illustrating operations of the cleaning device according to an embodiment of the present disclosure.
Figure 9:
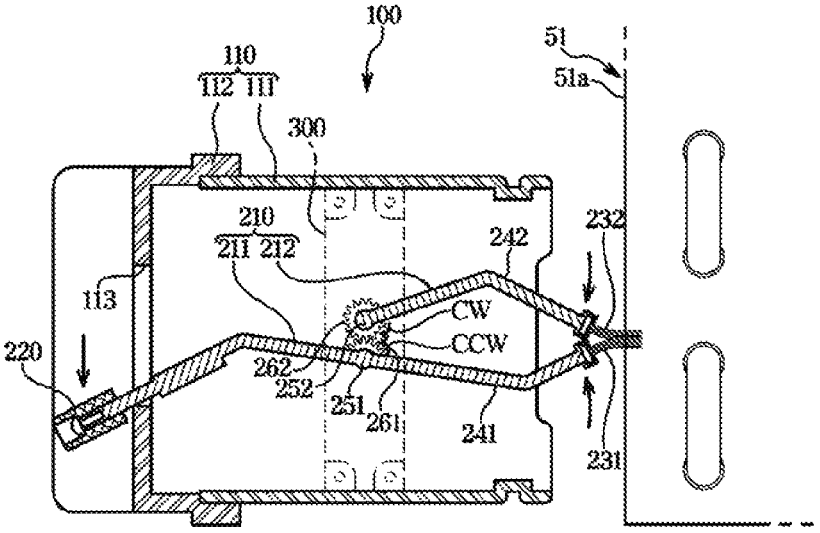

FIGS. 8 and 9 are views illustrating operations of the cleaning device according to an embodiment of the present disclosure.

As illustrated in FIGS. 8 and 9, when the brush handle 220 connected to the first brush 211 of the cleaning device 100 is pressed downward, the first brush hinge 241 of the first brush 211 rotates in a first direction CCW about the first rotation shaft 251.

When the first brush hinge 241 rotates in the first direction CCW, the first bristles 231 provided at the end of the first brush hinge 241 rotationally moves upward.

At this time, the second connection gear 262 engaged with the first connection gear 261 of the first rotation shaft 251 of the first brush hinge 241 rotates in a second direction CW.

When the second connection gear 262 rotates in the second direction CW, the second rotation shaft 252 rotates in the second direction CW, and the second brush hinge 242 rotationally moves in the second direction CW, that is, downward by the rotation of the second rotation shaft 252.

Accordingly, the first bristles 231 moves upward and the second bristles 232 move downward.

The first bristles 231 and the second bristles 232 approach toward the center. In this movement, each of the first bristles 231 and the second bristles 232 gathers foreign substances such as dust and lint attached to the surface 51*a* of the heat exchanger 51 in contact with each other, in the center.

Conversely, when the brush handle 220 connected to the first brush 211 moves upward, the first brush hinge 241 of the first brush 211 rotates in the second direction CW about the first rotation shaft 251.

When the first brush hinge 241 rotates in the second direction CW, the first bristle 231 provided at the end of the first brush hinge 241 rotationally moves downward.

At this time, the second connection gear 262 engaged with the first connection gear 261 of the first rotation shaft 251 of the first brush hinge 241 rotates in the first direction CCW.

When the second connection gear 262 rotates in the first direction CCW, the second rotation shaft 252 rotates in the first direction CCW, and the second brush hinge 242 rotationally moves in the first direction CCW, that is, upward by the rotation of the second rotation shaft 252.

The user may separate and discharge foreign substances, such as dust and lint collected between the first bristle 231 and the second bristles 232 by the vertically repeated movement of the first bristle 231 and the second bristles 232 as described above, to the outside of the main body 10 using the cleaning device 100.

Figure 10:
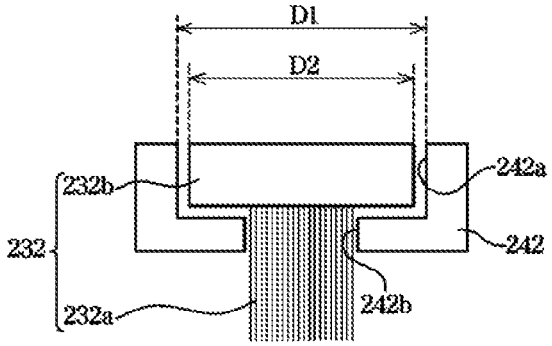
FIG. 10 is an enlarged view of part A in FIG. 8, illustrating a brush of the cleaning device according to an embodiment of the present disclosure.

FIG. 10 is an enlarged view of part A in FIG. 8, illustrating a brush of the cleaning device according to an embodiment of the present disclosure.

As illustrated in FIG. 10, the first bristle 231 and the second bristles 232 of the cleaning device 100 may be separated from the first brush hinge 241 and the second brush hinge 242.

A second brush installation portion 242*a* may be formed on the second brush hinge 242 so that the second bristles 232 may be installed. The second bristles 232 may include a plurality of bristles 232*a* and a brush frame 232*b* on which the plurality of bristles 232*a* is installed. The brush frame 232*b* may be inserted into the second brush installation portion 242*a* of the second brush hinge 242.

In this case, a first distance D1 of the second brush installation portion 242*a* may be formed to be larger than a second distance D2 of the brush frame 232*b*. The brush frame 232*b* is formed to be smaller than the second brush installation portion 242*a* and may be fixed by being inserted and press-fitted into the second brush installation portion 242*a*. A bristle installation hole 242*b* may be formed on the second brush installation portion 242*a* so that the plurality of bristles 232*a* of the second bristles 232 may pass therethrough.

The second bristles 232 inserted and press-fitted into the second brush installation portion 242*a* as described above may be separated from the second brush hinge 242, so that maintenance and replacement of the second bristles 232 are possible. The first bristles may be equally applied.

Figure 11:
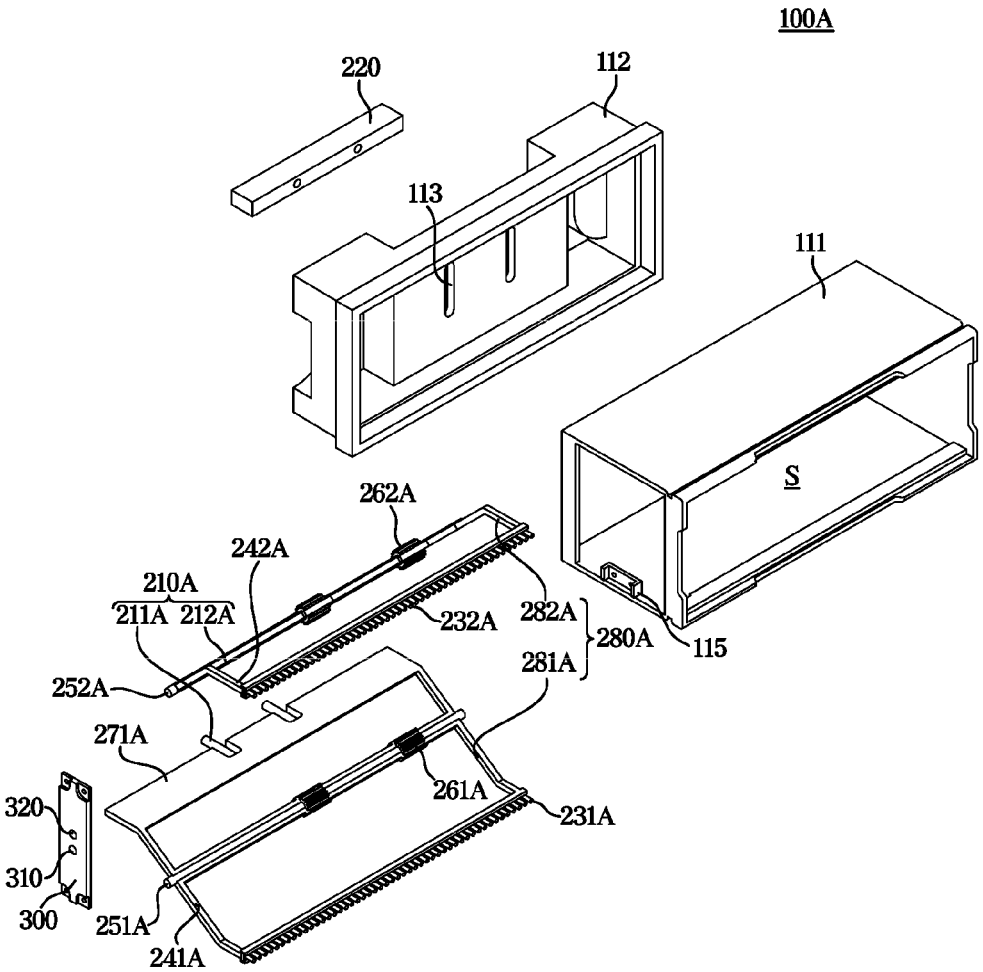
FIG. 11 is an exploded perspective view of a cleaning device according to another embodiment of the present disclosure.

FIG. 11 is an exploded perspective view of a cleaning device according to another embodiment of the present disclosure. Reference numerals not shown refer to FIGS. 1 to 10.

As illustrated in FIG. 11, a cleaning device 100A includes a brush 210A provided to come into contact with the heat exchanger 51 and a brush handle 220A provided to move the brush 210A.

The brush 210A may include a first brush 211A connected to the brush handle 220A and a second brush 212A provided to interlock with the first brush 211A.

The first brush 211A and the second brush 212A may include first bristles 231A and second bristles 232A provided to come into contact with the surface 51*a* of the heat exchanger 51, and a first brush hinge 241A on which the first bristles 231A are mounted and a second brush hinge 242A on which the second bristles 232A is mounted, respectively.

The first brush hinge 241A is provided to be rotatable by a predetermined angle so that the first bristles 231A installed at one end thereof is vertically movable.

The first brush hinge 241A may be provided with a first rotation shaft 251A provided such that the first brush 211A is rotatable. The first bristles 231A may be provided to be rotatable about the first rotation shaft 251A. The first brush hinge 241A may include a first brush handle insert 271A so that the brush handle 220A may be connected. The first brush handle insert 271A may be disposed on the other side of the first brush hinge 241A opposite to one side on which the first bristle 231A is provided. That is, the first brush hinge 241A rotates about the first rotation shaft 251A located at the center thereof. When the first brush handle insert 271A is pressed, the first brush hinge 241A rotates about the first rotation shaft 251A so that the first bristles 231A may move in the vertical direction.

The second brush hinge 242A is provided to be rotatable by a predetermined angle so that the second bristles 232A installed at one end thereof is vertically movable. The second brush hinge 242A may be provided with a second rotation shaft 252A provided such that the second brush 212A is rotatable. The second bristles 232A may be provided to be movable about the second rotation shaft 252A.

At least one of the first brush hinge 241A and the second brush hinge 242A may include an air flow passage 280A formed by opening at least a portion or the whole for air flow. The air flow passage 280A is provided to reduce air resistance.

The air flow passage 280A may include a first air flow passage 281A formed on the first brush hinge 241A, and a second air flow passage 282A formed on the second brush hinge 242A.

The air flow passage 280A of the first brush hinge 241A and second brush hinge 242A is formed such that air in the main body 10 may smoothly flow toward the heat exchanger 51.

Because the detailed configuration and operation of the cleaning device 100A of the clothes dryer including the above-described configuration are the same as those of the above-described embodiment, the overlapping description will be omitted.

Figure 12:
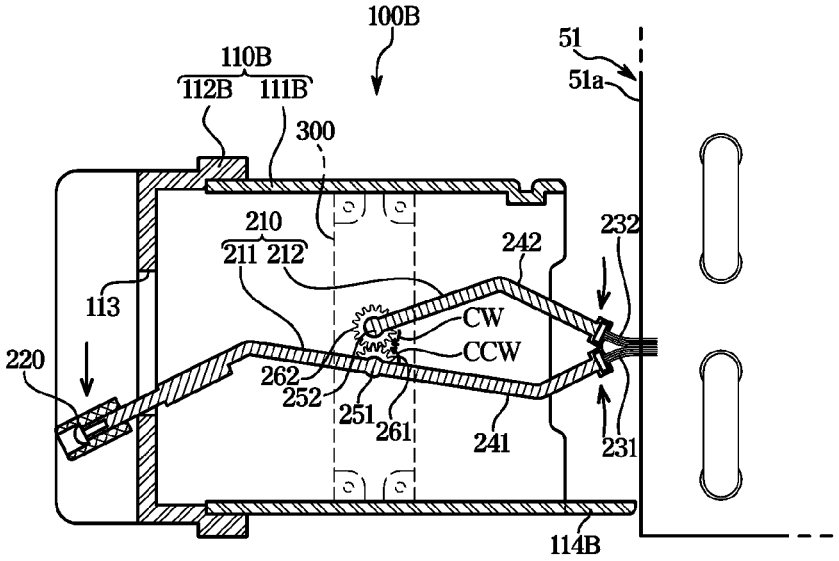
FIG. 12 is a view illustrating a cleaning device according to another embodiment of the present disclosure.

FIG. 12 is a view illustrating a cleaning device according to another embodiment of the present disclosure. Reference numerals not shown refer to FIGS. 1 to 10.

As illustrated in FIG. 12, a cleaning device 100B is configured as a frame 110B. The frame 110B includes a first frame 111B and a second frame 112B provided to be detachably coupled to the first frame 111B.

The first frame 111B and the second frame 112B may be combined to form one body. The second frame 112B may be disposed in front of the first frame 111B.

The first frame 111B may further include a dust receiving plate 114B formed to extend to a length of the first bristles 231 and the second bristles 232. Specifically, the dust receiving plate 114B may be formed to extend from a bottom surface of the first frame 111B. The dust receiving plate 114B may be formed to receive dust and foreign substances falling downward by the first bristles 231 and the second bristles 232 coming into contact with the surface 51*a* of the heat exchanger 51. The dust and foreign substances received in the dust receiving plate 114B may be separated and discharged together with the cleaning device 100B when the cleaning device 100B is separated from the main body 10.

Figure 13:
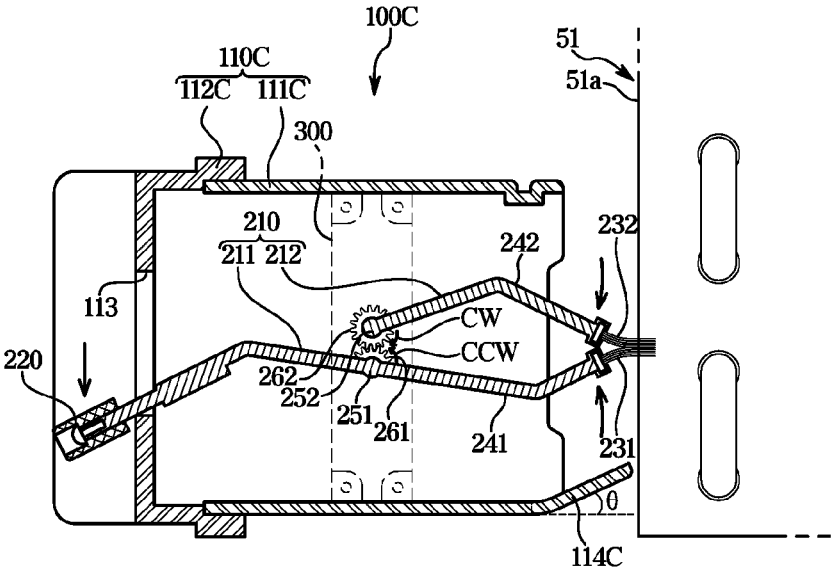
FIG. 13 is a view illustrating a cleaning device according to another embodiment of the present disclosure.

FIG. 13 is a view illustrating a cleaning device according to another embodiment of the present disclosure. Reference numerals not shown refer to FIGS. 1 to 10.

As illustrated in FIG. 13, a cleaning device 100C may be configured as a frame 110C including a first frame 111C and a second frame 112C provided to be detachably coupled to the first frame 111C.

The first frame 111C may further include a dust receiving plate 114C formed to extend to the length of the first bristles 231 and the second bristles 232. Specifically, the dust receiving plate 114C may be formed to extend from a bottom surface of the first frame 111C. The dust receiving plate 114C may be formed to be inclined at a predetermined angle θ from the bottom surface of the first frame 111C. The dust receiving plate 114C may be formed to be inclined at the first angle θ from the bottom surface of the first frame 111C. Dust and foreign substances gathered in the center by the dust receiving plate 114C inclined at the first angle θ may be separated and discharged together with the cleaning device 100C when the cleaning device 100C is separated from the main body 10.

The foregoing has illustrated and described specific embodiments. However, it should be understood by those of skilled in the art that the disclosure is not limited to the above-described embodiments, and various changes and modifications may be made without departing from the technical idea of the disclosure described in the following claims.

What is claimed is:

1. A clothes dryer comprising:
- a main body;
- a drum rotatably provided in the main body;
- a heat exchanger provided to supply hot and dry air to an inside of the drum; and
- a cleaning device detachably installed in the main body to clean the heat exchanger,
- wherein the cleaning device comprises:
  - a first frame;
  - a second frame detachably coupled to the first frame;
  - brushes provided on the first frame to come into contact with at least one surface of the heat exchanger, and comprising a first brush and a second brush provided to interlock with the first brush;
  - a brush handle provided on the second frame to move the brushes;
  - a handle guide provided on the second frame to guide movement of the brush handle; and
  - a rotatable joint provided to rotatably connect the first brush and the second brush,
  - wherein the rotatable joint comprises a first connection gear provided on the first brush, a second connection gear provided on the second brush, and the first connection gear and the second connection gear are intermeshed to rotate in opposite directions.

2. The clothes dryer according to claim 1, wherein the first brush comprises:
- first bristles provided to come into contact with a surface of the heat exchanger; and
- a first brush hinge on which the first bristles are mounted and rotatably provided about a first rotation shaft so that the first bristles are movable.

3. The clothes dryer according to claim 2, wherein the second brush comprises:
- a second bristles provided to come into contact with the surface of the heat exchanger; and
- a second brush hinge on which the second bristles are mounted and rotatably provided about a second rotation shaft so that the second bristles are movable.

4. The clothes dryer according to claim 3, wherein the first brush and the second brush are provided to rotate in opposite directions.

5. The clothes dryer according to claim 3, wherein at least one of the first brush hinge or the second brush hinge further comprises a cutout portion formed by cutting at least a portion of the at least one of the first brush hinge or the second brush hinge.

6. The clothes dryer according to claim 5, wherein at least one surface of the first frame further comprises a dust receiving plate extending to a length of the first bristles and the second bristles.

7. The clothes dryer according to claim 6, wherein the dust receiving plate is formed to be inclined with respect to the at least one surface of the first frame.

8. The clothes dryer according to claim 3, wherein at least one of the first brush hinge or the second brush hinge further comprises an air flow passage formed by opening at least a portion or whole of the at least one of the first brush hinge or the second brush hinge for air flow.

9. The clothes dryer according to claim 3, wherein:
- the first connection gear is disposed on the first rotation shaft,
- the second connection gear is disposed on the second rotation shaft, and
- when the first rotation shaft rotates in a first direction counterclockwise (CCW) by the rotation of the first brush hinge, the second rotation shaft rotates in a second direction clockwise (CW) that is opposite to the first direction CCW, so that the first bristles and the second bristles intermingle.

10. The clothes dryer according to claim 9, further comprising a rotation bracket provided to rotatably support the first rotation shaft and the second rotation shaft,
- wherein the rotation bracket is provided on the first frame.

11. The clothes dryer according to claim 9, wherein the first bristles and the second bristles are provided to have different materials.

12. The clothes dryer according to claim 1, wherein the first frame further comprises a space portion formed to allow air to flow.

13. A cleaning device detachably installed in a clothes dryer to clean a heat exchanger, the cleaning device comprises:
- a first frame;
- a second frame detachably coupled to the first frame;
- brushes provided on the first frame to come into contact with at least one surface of the heat exchanger and comprising a first brush and a second brush provided to interlock with the first brush;

a brush handle provided on the second frame to move the brushes;

a handle guide provided on the second frame to guide movement of the brush handle; and a rotatable joint provided to rotatably connect the first brush and the second brush, wherein the rotatable joint comprises a first connection gear provided on the first brush, a second connection gear provided on the second brush, and the first connection gear and the second connection gear are intermeshed to rotate in opposite directions.

14. The cleaning device according to claim 13, wherein the first brush comprises:

first bristles provided to come into contact with a surface of the heat exchanger; and a first brush hinge on which the first bristles are mounted and rotatably provided about a first rotation shaft so that the first bristles are movable.

15. The cleaning device according to claim 14, wherein the second brush comprises:

a second bristles provided to come into contact with the surface of the heat exchanger; and a second brush hinge on which the second bristles are mounted and rotatably provided about a second rotation shaft so that the second bristles are movable.

* * * * *